US007066494B1

(12) United States Patent
Di Prinzio

(10) Patent No.: US 7,066,494 B1
(45) Date of Patent: Jun. 27, 2006

(54) MAGNETIC PAGE MARKER

(76) Inventor: Nicolaś Javier Di Prinzio, 20 De Junio 569 Quilmes, Buenos Aries (AR) 1879

( * ) Notice: Subject to any disclaimer, the term of this patent is extended or adjusted under 35 U.S.C. 154(b) by 0 days.

(21) Appl. No.: 09/628,146

(22) Filed: Jul. 28, 2000

(30) Foreign Application Priority Data

Jul. 29, 1999 (AR) ..... P990103755

(51) Int. Cl.
*B42D 9/00* (2006.01)

(52) U.S. Cl. ..... 281/42; 281/45; 281/DIG. 1; 116/234; 283/21; 283/36; 283/37; 283/38; 283/74; 24/67.5; 24/67.9; 24/67 R; 24/303; 248/206.5; 248/303; 248/309.4; 248/441.1; 248/450; 248/451; 402/503; D19/34; D19/65; D19/91

(58) Field of Classification Search ..... 283/21, 283/36, 74, 37, 38; 281/42, 45, DIG. 1; 24/67.5, 67.9, 67 R, 303; 248/441.1, 450, 248/451, 206.5, 309.4, 303; D19/34, 65, D19/91; 402/503; 116/234
See application file for complete search history.

(56) References Cited

U.S. PATENT DOCUMENTS

| | | | | | |
|---|---|---|---|---|---|
| 2,448,611 | A | * | 9/1948 | Martin | |
| 2,630,777 | A | * | 3/1953 | Johnson | |
| 3,529,328 | A | * | 9/1970 | Davison | |
| 4,162,659 | A | * | 7/1979 | Burke | 116/234 |
| 4,201,403 | A | * | 5/1980 | Turner | 283/21 |
| 4,255,837 | A | * | 3/1981 | Holtz | 24/243 R |
| 4,602,734 | A | * | 7/1986 | Thompson | 229/77 |
| 4,680,210 | A | * | 7/1987 | Corcoran | 428/42 |
| 4,688,510 | A | * | 8/1987 | McNeely | 116/237 |
| 4,962,603 | A | * | 10/1990 | Kao et al. | 40/641 |
| 5,103,756 | A | * | 4/1992 | Korkames | 116/234 |
| D332,113 | S | * | 12/1992 | Yates | D19/34 |
| 5,287,823 | A | * | 2/1994 | Jiang | 116/237 |
| 5,375,884 | A | * | 12/1994 | Farrington | 281/42 |
| 5,380,043 | A | * | 1/1995 | Schwartz | 281/15.1 |
| 5,425,160 | A | * | 6/1995 | Krapf | 24/67 R |
| 5,503,102 | A | * | 4/1996 | McDonell | 116/238 |
| 5,682,653 | A | * | 11/1997 | Berglof et al. | 224/183 |
| 6,015,166 | A | * | 1/2000 | May | 281/42 |
| 6,401,649 | B1 | * | 6/2002 | Smith | 116/234 |
| 2002/0104473 | A1 | * | 8/2002 | Smith | 116/234 |

FOREIGN PATENT DOCUMENTS

| | | | |
|---|---|---|---|
| AU | 9047866 | A * | 7/1990 |
| CA | 02231036 | * | 7/1999 |
| GB | 2315705 | A1 * | 11/1998 |
| JP | 09123639 | A * | 5/1997 |
| JP | 11078293 | * | 3/1999 |

OTHER PUBLICATIONS

*Webster's Third New International Dictionary of the English Language Unabridged*, G. & C. Merriam Company, Massachusetts, 1981, p. 1608.

*The New Shorter Oxford English Dictionary on Historical Principles* vol. 2, N-Z, Clarendon Press, Oxford, 1993, p. 2052.

* cited by examiner

*Primary Examiner*—Boyer Ashley
*Assistant Examiner*—Mark Henderson
(74) *Attorney, Agent, or Firm*—Robert E. Bushnell, Esq.

(57) ABSTRACT

The present invention consists of a magnetic page marker comprised by a pair of laminar walls which form a clip applicable to the edge of the page that is intended to mark. Into the clip, there is a pair of magnetic means which clasp said page, whose admission into the clip is facilitated by an inner cover. The bookmark has a signalling tab which jutts out notoriously respect the edges of the pages.

15 Claims, 10 Drawing Sheets

10
6'
6
2
1
7
3
7'
5
5'

10
6'
6
2
1
7
3
7'
5
12
5'

MAGNETIC PAGE MARKER

I—BACKGROUND OF THE INVENTION

1. Field of the Invention

The present invention consists of a magnetic page marker which applied to books or notebooks, allows to place the marker on the page without opening the clips formed by its laminar walls where there are magnetic means with a cover for each of them.

2. Description of the Prior Art

The use of bookmarks, also called markers, is very well known to identify a book or notebook page where the reader has stopped reading, and where he wishes to come back later readily.

The simplest conventional bookmarks are elongated laminar sheets placed between the page intended to mark and the immediately prior or next one, so that it is held between both pages and with one of its ends projecting out from the set of pages, once the book or notebook has been closed.

This type of bookmark present numerous disadvantages. One of them is that, if several pages are intended to be marked by using several bookmarks, upon closing the book, the bookmarks will remain overlapped, marking the access to the different marked pages difficult.

Another disadvantage is that, as the bookmark is held by the pages by binding it, upon opening the book, it usually drops.

Australia Patent No. AU-A-47866/90 refers to a bookmark made of two magnetic elements whose respective supports are joined by a flexible means. The latter has the disadvantage of complicating the operation of placing it on the page because, until the magnetic elements stay well opposite each other, the bookmark is not fixed and may drop from the reader's hands.

South Africa Patent No. 95/8805 refers to a bookmark consisting of a pair of pieces, each of them provided with the respective magnetic elements and joined by a hinge, so that the book page lies between both pieces. In this case, the hinge is indispensable because, if a marker were placed closed (with its magnetic elements in contact), the book page would meet resistance to penetrate.

One of these difficulties may be due to a very thin page which cannot separate the magnetic elements in order to penetrate between them. The other difficulty that occurs is that the page edge impinges against the prominent edges of the magnetic means.

II—SUMMARY OF THE INVENTION

The object of the present page marker is to provide a marking means for book or notebook pages, whose laminar walls form a clip that may be placed without opening. This is because the magnetic means have a cover which facilitates the admission of the edge of the page.

OBJECTS AND ADVANTAGES

The present bookmark is comprised by a clip which clasps the page on an edge and remains fixed by the mutual attraction of the magnetic means. The cover covering thereof prevents the edge of the page from folding or impinging against the prominent edges of said magnetic means upon placing the bookmark. In consequence, it facilitates the admission of the page within the clip formed by the laminar walls and the magnetic means need not be separated manually in order to introduce the page.

Optionally, between the ends of the clip and the prominent edges of the magnetic means, the laminar walls may have laminar supplements each with similar height to said magnetic means, so that there is no unlevelling within the page admission area.

The laminar walls may have different sizes so that graphic advertising and/or ornamental prints can be applied on their surfaces, as well as forming embossment.

In addition to the inner cover, the bookmark may have an outer cover covering it totally or partially.

At the joint area between the laminar walls there may be a tab so that, once the bookmark is applied, it projects out ot the pages heap and facilitates marking.

Longitudinal edges of the laminar walls or, eventually, openings are used as line markers on the page marked.

Ornamental type openings may also be included.

The laminar walls may also serve as support for electronic devices with displays, such as flat clocks, thermometers, or calculators.

III—DESCRIPTION OF THE DRAWINGS

For the purpose of clarity and better understanding of the object of the invention, several drawings illustrate it wherein it has been represented in its preferred embodiments, only in an illustrative, but not limiting manner:

Figure 2:
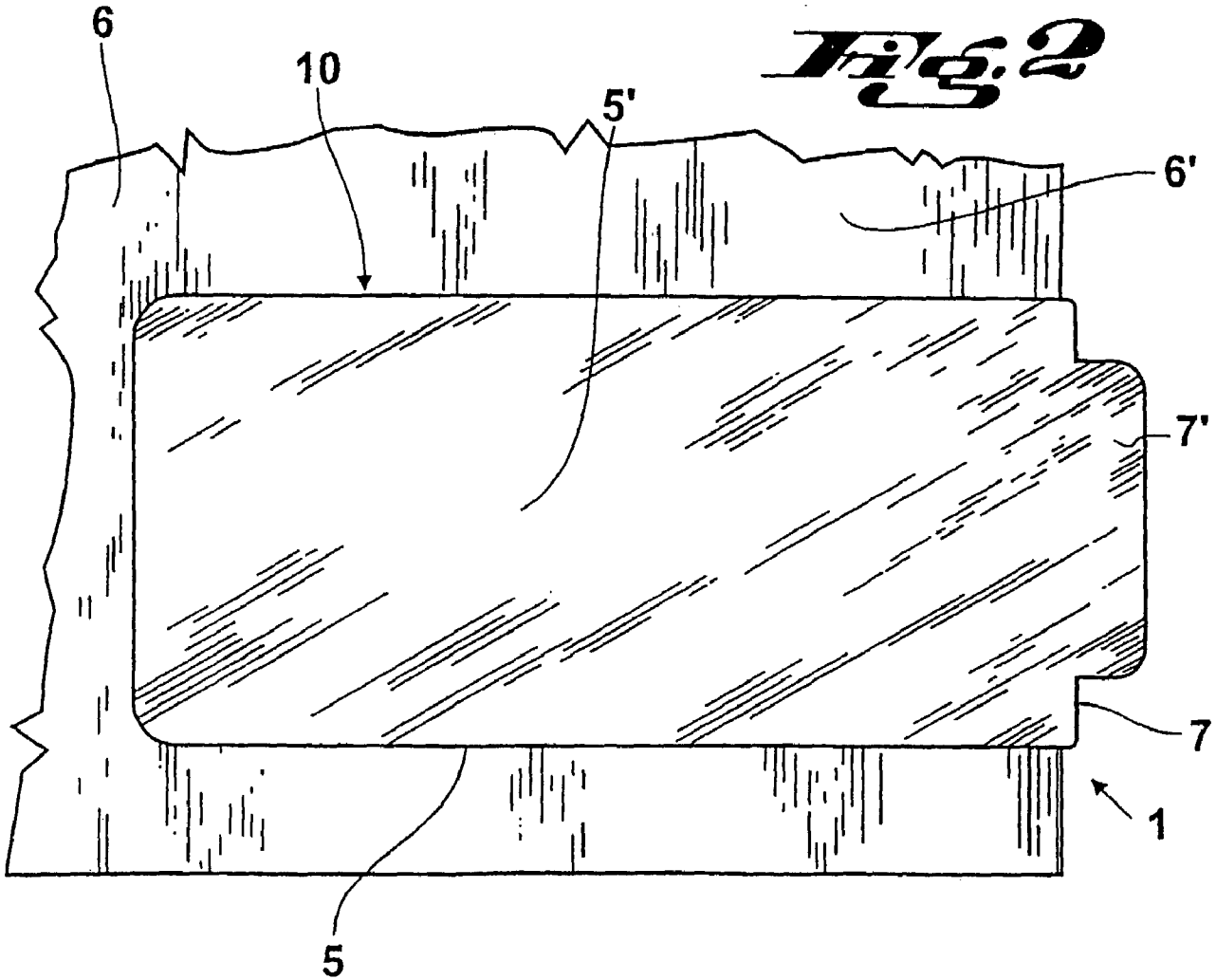

FIG. 2 is a front view of the bookmark already introduced on the edge of the page. It can be appreciated the surface of the longer laminar wall may serve to apply advertising or ornamental prints. It can be seen how the signaling tab and the upper longitudinal edge which marks the line jut out.

Figure 2A:
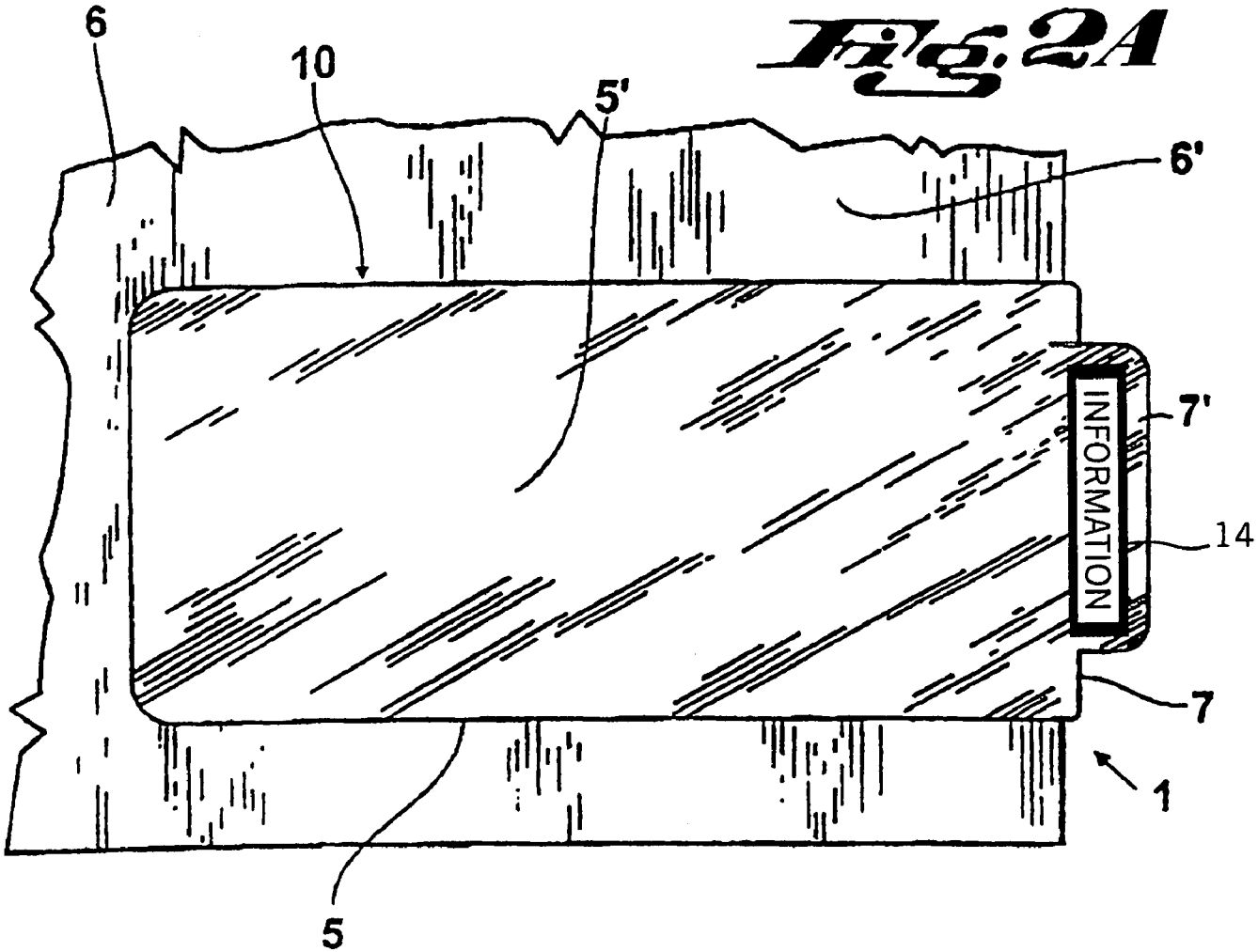

FIG. 2A illustrates an exterior surface protruding from the throat, oriented to bear a device providing a display of information.

FIG. 3 is a lower view where it can be appreciated how a book page is clasped by the clip formed by the bookmark and the magnetic means.

FIG. 3A is an exploded detailed view of FIG. 3 where it can be seen how the cover covers the edges of the magnetic means to facilitate the entrance of the page into the clip.

Figure 3B:
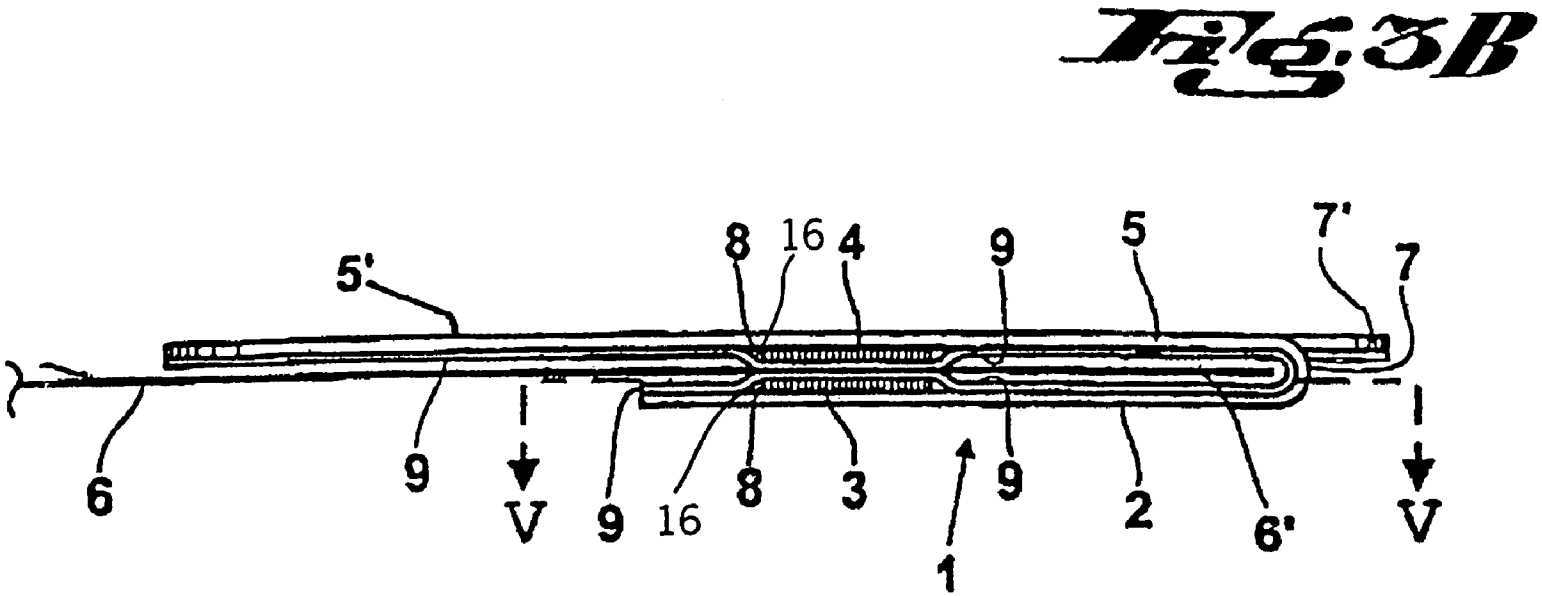

FIG. 3B illustrates edge members found on the base and clip portions.

Figure 3C:
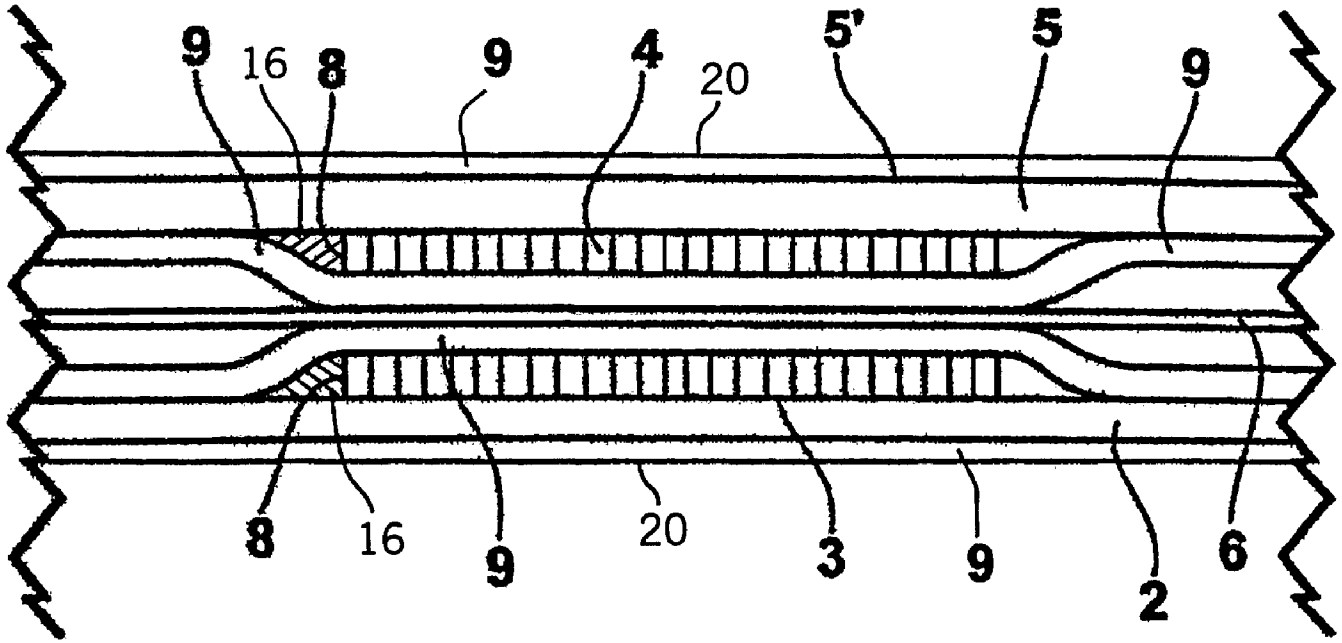

FIG. 3C illustrates an outer cover member formed on the external surfaces of the page marker.

Figure 4:
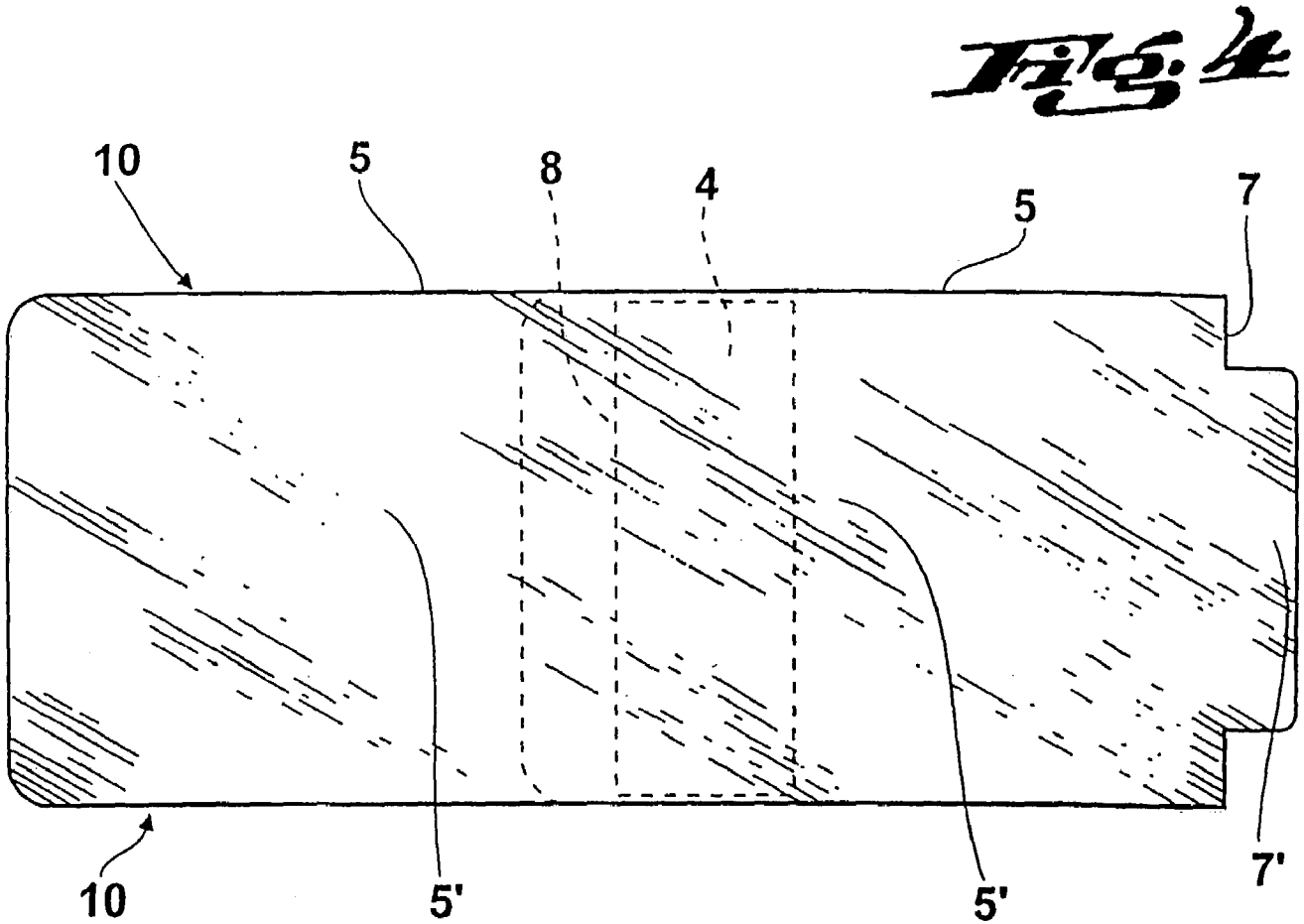

FIG. 4 is a front view of the bookmark where the shape of the longer laminar wall can be appreciated.

Figure 4A:
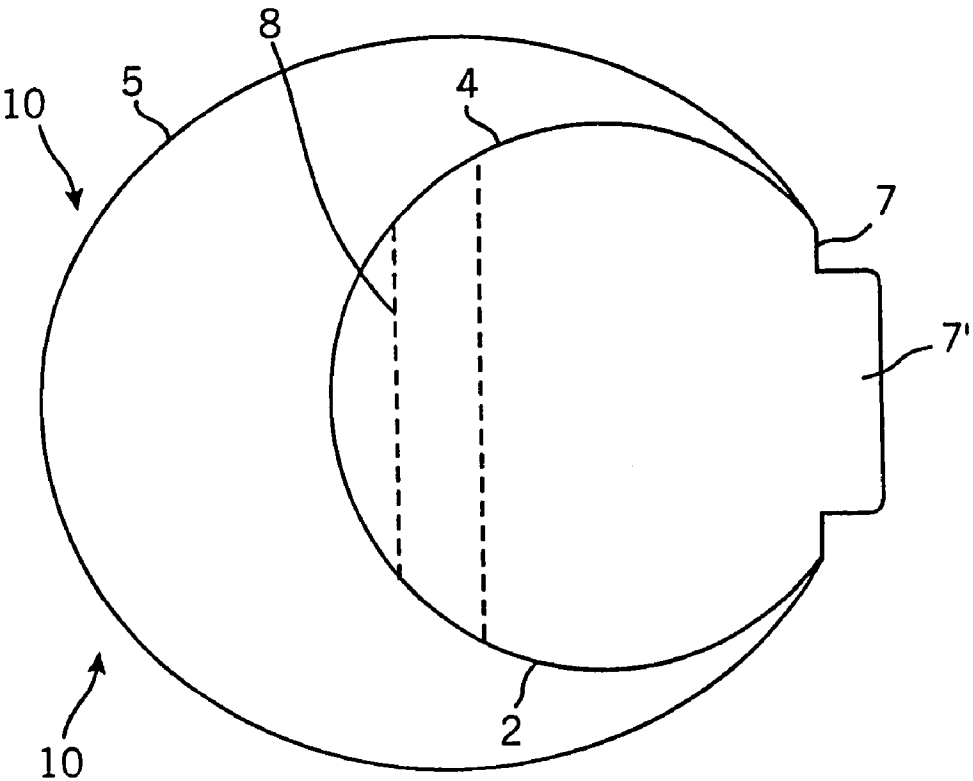
Figure 5:
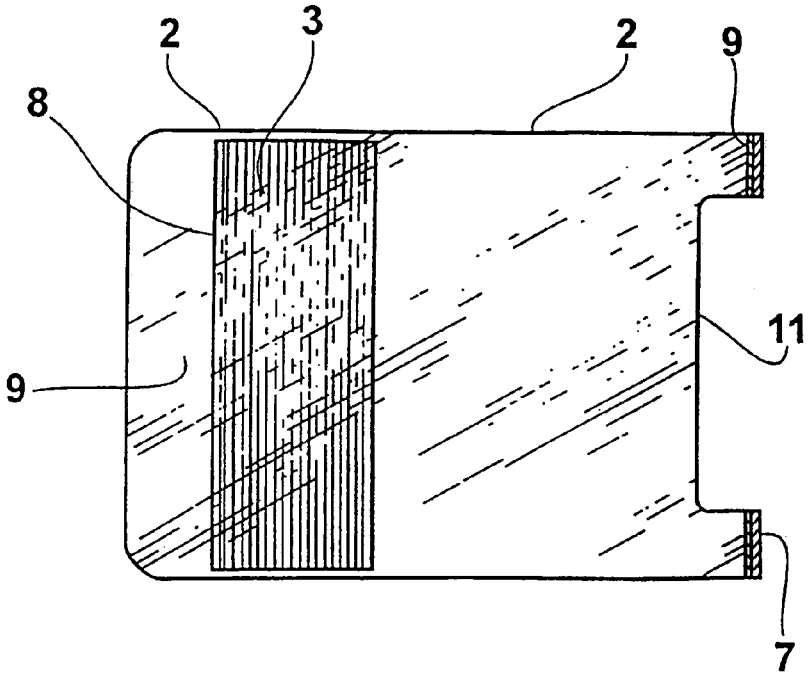
Figure 5A:
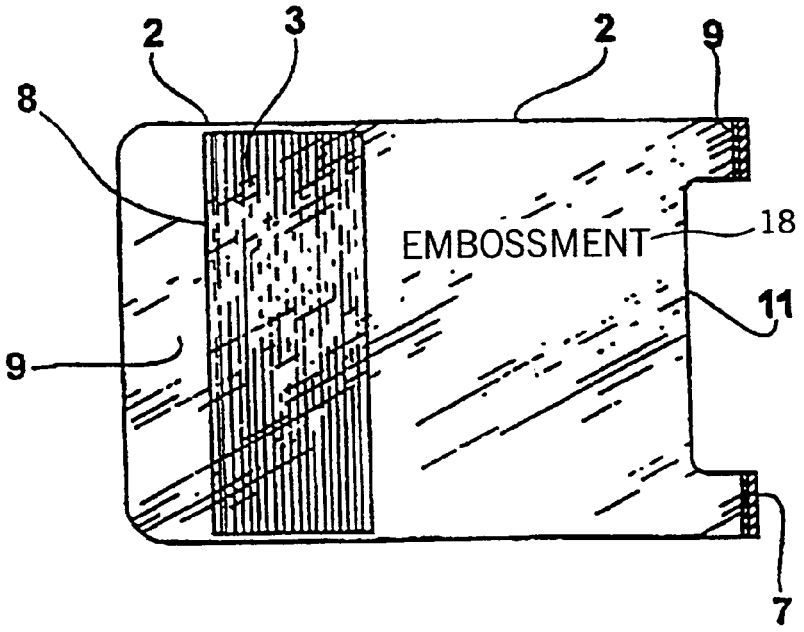

FIG. 4A illustrates circular wall members.

Figure 5:
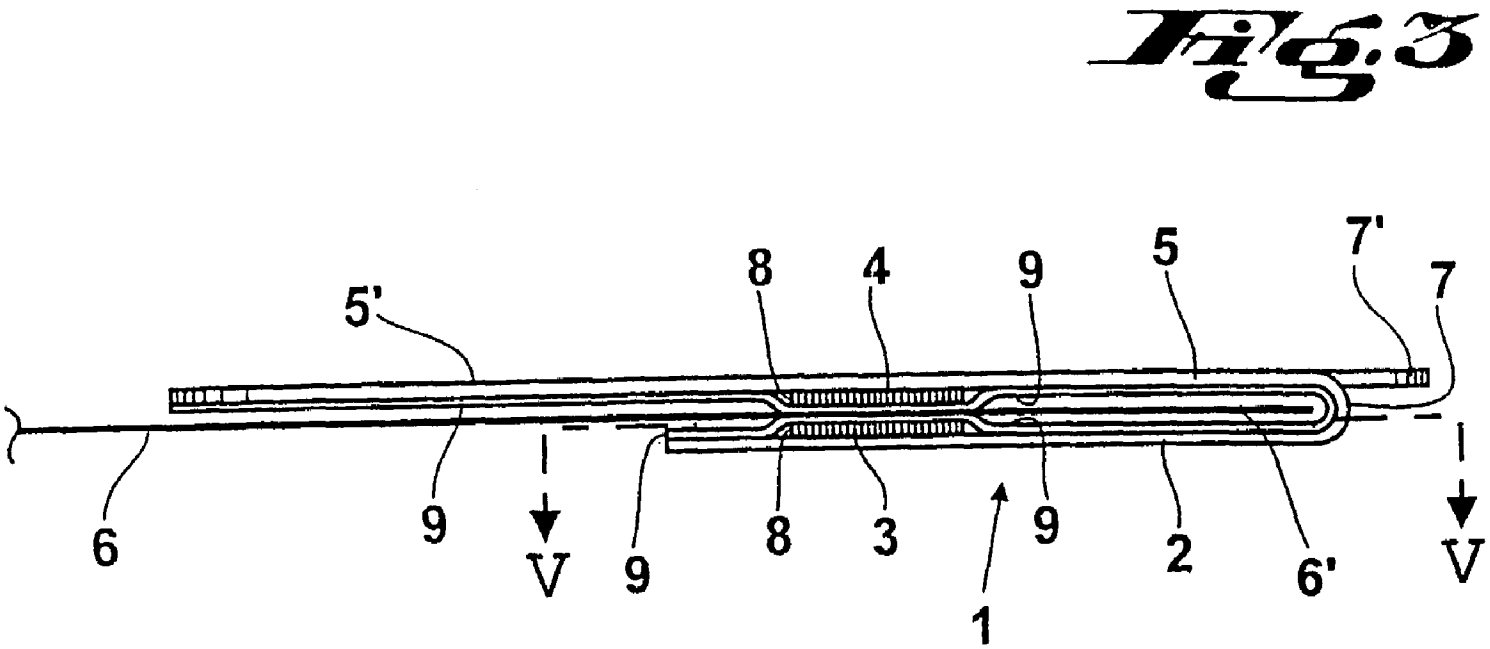

FIG. 5 is a longitudinal cut view of the bookmark as viewed along sectional line V—V in FIG. 3 allowing the observation of the inner aspect of the shorter laminar wall.

Figure 5A:
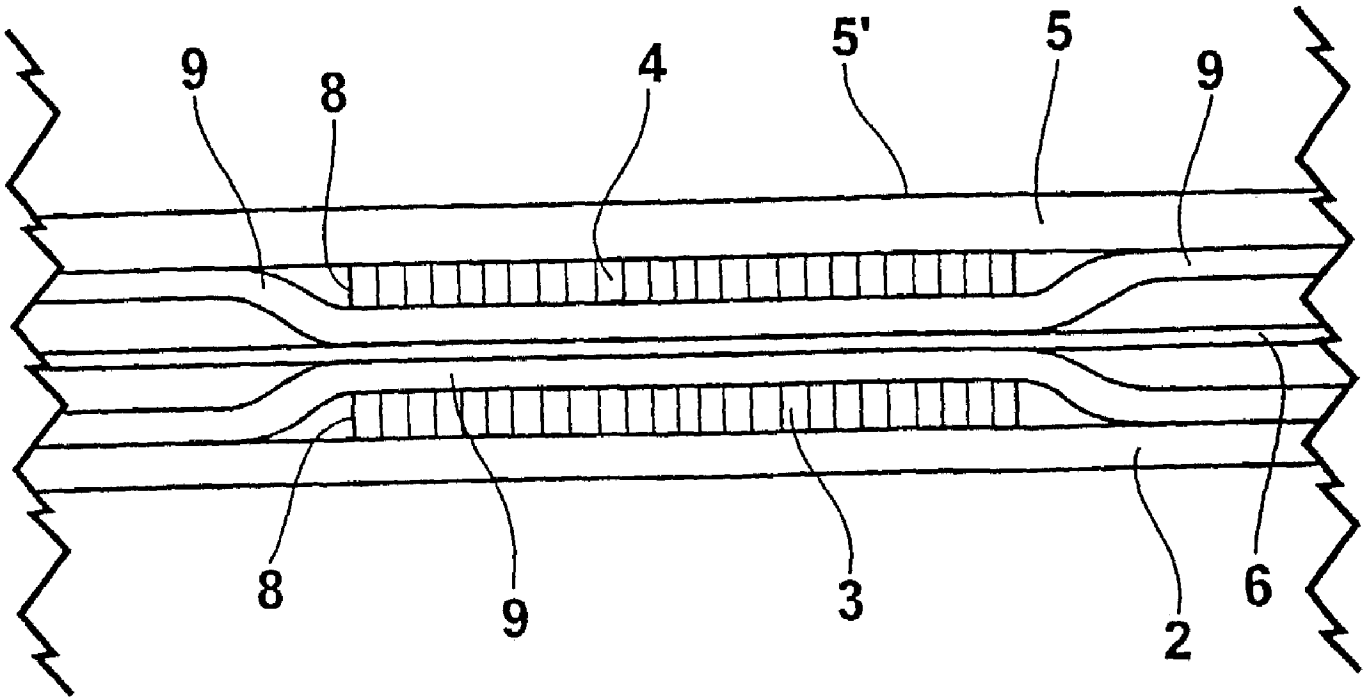

FIG. 5A illustrates an external surface providing an application surface for embossment.

Throughout the different drawings, the same reference numerals indicate equal or corresponding parts, and the sets of different elements have been indicated using letters.

REFERENCE NUMERALS IN DRAWINGS (1) Bookmark clip formed by laminar walls (2)(5).

(2) Shorter laminar wall (3) First magnetic means fixed on the shorter laminar wall (2)

(4) Second magnetic means fixed on the longer laminar wall (5).

(5) Longer laminar wall (5') Surface of the longer laminar wall (5) to apply graphic advertising or ornamental prints.

(6) Page of a book to which the bookmark is applied.

(6') Edge of the page (6) clasped by the bookmark clip (1)

(7) Joint between both laminar walls (2) (5).

(7') Tab jutting out from the joint (7).

(8) Prominent edges of the magnetic means (3) (4).

(9) Cover which covers the prominent edges (8).

(10) Longitudinal edges of the longer laminar wall (5) which serve to mark the lines on the page (6).

(11) Recess from which the tab is formed (7).

IV—DETAILED DESCRIPTION

Figure 1:
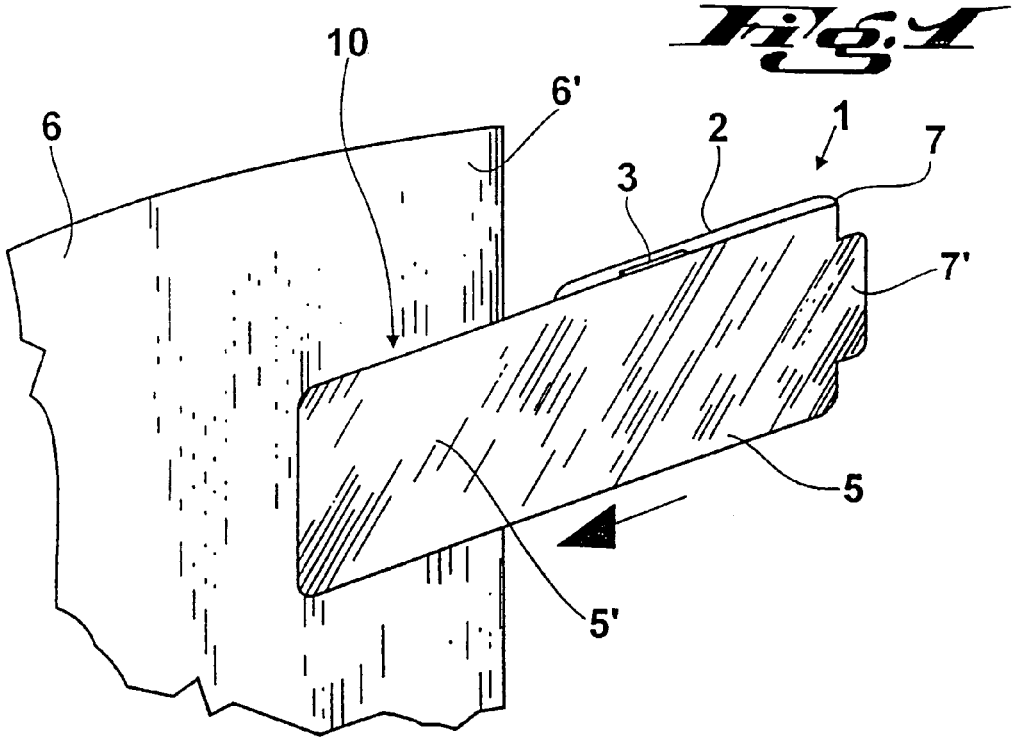
FIG. 1 is a perspective view illustrating the way the bookmark is placed on the edge of the page.
Figure 1A:
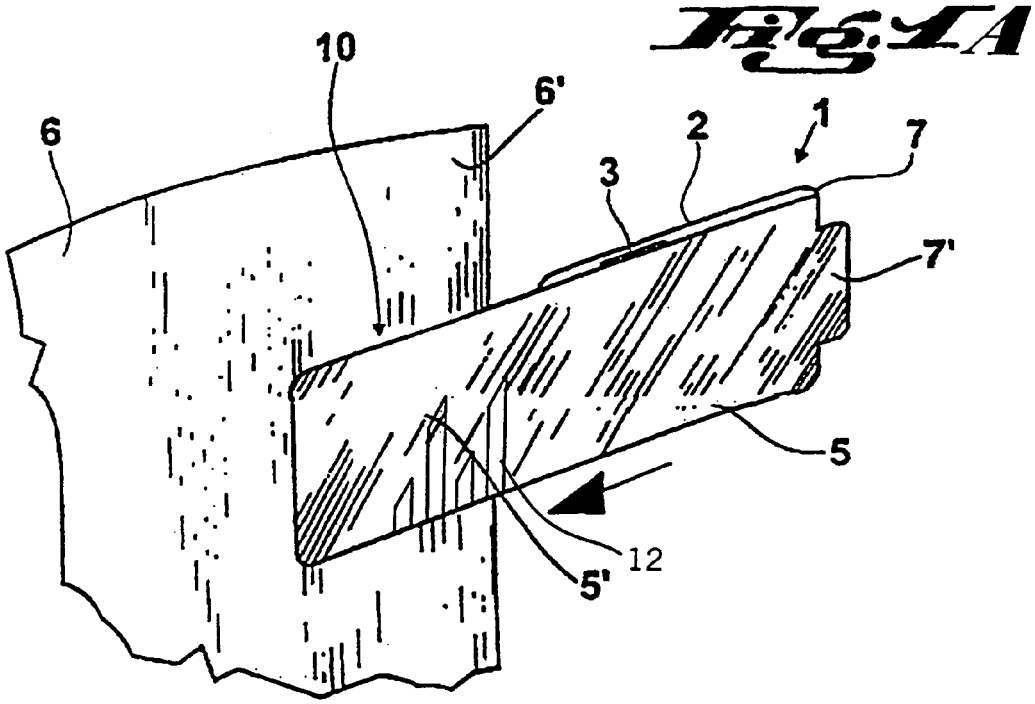
FIG. 1A illustrates an alternative embodiment with openings providing line identification on a page of a book.

FIG. 1 shows the bookmark comprised by a pair of adjacent laminar walls (2) (5), which have a joint (7) on one end and on the opposite end they form a clip (1) dedicated to clasp the edge (6') of the page (6). Into the clip (1) there are two magnetic means (3)(4) having a mutual attraction force.

FIG. 2 shows the longer laminar wall (5) whose large surface (5') can be used to apply graphic prints such as advertising messages or ornaments and whose longitudinal edge (100 is a line marking means. At the joint (7) between both walls (2) (5) a tab (7') juts out outstanding noticeably from the edge (6') of the page (6).

FIG. 3 shows how the edge (6') of the page (6) is inserted into the clip (1) formed by the laminar walls (2) (5) and the magnetic means (2)(5) with the cover (9).

FIG. 3A shows an exploded view of FIG. 3, wherein it can be seen in detail the first magnetic means (3) fixed to the shorter laminar wall (2) and to the second laminar wall (4) fixed to the longer laminar wall (5). Both magnetic means (3)(4) are covered by the cover (9), particularly its prominent edges (8). Therefore, the above mentioned cover (9) prevents the impingements between the page (6) and said prominent edges (8), facilitating the entrance thereof (6) into the clip (1). FIGS. 3B, 3C show wedge elements 16 structurally arranged to cooperate with the magnetic members in order to permit the page of the book to be latterly received within the throat of the clip marker. FIG. 3C also shows outer cover members (20) borne by the external surfaces of the page marker opposite the throat opening.

FIG. 4 shows the longer laminar wall (5), whose longitudinal edges (10) serve as line marking means and from one of its transverse edges the tab jutts out (7').

In FIG. 5, the cut shows the shorter laminar wall (2) which, in the inner part of the clip (1), has the first magnetic means fixed (3), above which there is the cover (9) (in this case, it is transparent). Recess (11) on the transverse edge results from the cut with which the tab is formed (7').

In the present embodiment, the adjacent laminar walls (2) (5) are formed by a laminar sheet folded by means of a folding line which separates one wall respect the other.

The cover (9) may be transparent or not, and, in addition, it may be made of different materials, such as a layer of plastic or cellulosic material.

Operation

The clip (1) formed by laminar walls (2) (5) remains closed due to the mutual attraction force exerted by the magnetic means (3)(4), the page (6) being clasped in between them, such as it can be seen in FIGS. 1 and 2.

When introducing the bookmark on the edge (6') of the page (6), the entrance of the latter (6) is facilitated by the presence of the cover (9). This is due to the fact that cover (9) facilitates the page sliding (6) and prevents the impingement between the edge (6') of the page (6) and the prominent edges (8) of the magnetic means (3) (4), as it can be observed in FIGS. 3, 3A and 5.

The joint (7) between the shorter and longer walls (2) (5) acts as the stop of the pages (6) admission into the clip (1). Therefore, the tab (7') is the element which outstands most from the pages (6) once the bookmark is placed, as can be seen in FIGS. 2, 3 and 4.

I claim:

1. A magnetic clip marker for use in engaging and marking a page of a book, the clip marker including in combination:

magnetic members each exhibiting a thickness;

a pair of wall members of unequal length aligned and joined together at a throat to define an integral structure exhibiting an overlapped normal working position with opposite surfaces of said wall members providing a continuous interior surface extending between said throat and terminal ends of said wall members, with said wall members each being comprised of a base portion adjacent said terminal ends and a clip portion overlapping said base portion to define said throat as a junction between said wall members, said wall members supporting said magnetic members along said interior surface in aligned facing opposition to permit magnetic attraction between said magnetic members, said wall members being structurally arranged to receive insertion of a page of a book between said base portion and said clip portion until an edge of the page engages said throat; and a cover member disposed along said interior surface to form a continuous layer extending approximately from a first of said terminal ends, around said throat and to a second of said terminal ends while covering and separating said magnetic members and forming a continuously gradual structural transition between said interior surface and said magnetic members that accommodates a difference in separation between said opposite wall members and between said magnetic members attributable to said thickness allowing the insertion of the page within the throat.

2. The magnetic clip marker in accordance with claim 1, where the junction is arranged at a medium distance between the pair of magnetic members to provide said aligned facing opposition between the pair of magnetic members.

3. The magnetic clip marker in accordance with claim 1, where disparity of the longest wall member in relation to the opposite wall member and disposition of the cover member along the interior surface facilitate the insertion of the page within the throat.

4. The magnetic clip marker in accordance with claim 1, where a portion of the integral structure extends in a linear way to one of the wall members and in an opposite direction to the throat.

5. The magnetic clip marker in accordance with claim 1, where the cover member disposed on the surface of the integral structure of the clip is less thick than the wall members.

6. A magnetic clip marker for use in engaging and marking a page of a book, the clip marker including in combination:

a plurality of discrete magnetic members each exhibiting a thickness;

a pair of wall members of unequal length aligned and joined together at a throat to form an integral monolithic structure exhibiting a overlapped normal working position, with said wall members each being comprised of a base portion adjacent to a terminal end and a clip portion overlapping said base portion and extending to said throat, said wall members bearing said magnetic members mounted between said wall members in aligned facing opposition to permit magnetic attraction between said magnetic members, said wall members being oriented to receive insertion of a page of a book between said base portion and said clip portion until an edge of the page engages said throat; and a cover member disposed along said interior surface to form a continuous layer extending from a first said terminal end, around said throat and to a second said terminal end while covering and separating said magnetic members and forming a continuously gradual structural transition between a difference in separation between said opposite wall members and between said magnetic members attributable to said thickness enabling sliding insertion of the page within the throat.

7. The magnetic clip marker in accordance with claim 6, where the junction is arranged at a medium distance between the pair of magnetic members to provide said aligned facing opposition between the pair of magnetic members.

8. The magnetic clip marker in accordance with claim 6, where disparity of the longest wall member in relation to the opposite wall member and disposition of the cover member along the interior surface facilitate the insertion of the page within the throat.

9. The magnetic clip marker in accordance with claim 6, where a portion of the integral monolithic structure extends in a linear way to one of the wall members and in an opposite direction to the throat.

10. The magnetic clip marker in accordance with claim 6, where the cover member disposed on the surface of the monolithic integral structure of the clip marker is less thick than that of the structure of the wall members.

11. A magnetic clip marker for use in engaging and marking a page of a book, the clip marker including in combination:

magnetic members each exhibiting a thickness;

a pair of wall members of unequal length aligned and joined together at a throat to define an integral structure exhibiting a overlapped normal working position with opposite surfaces of said wall members providing a continuous interior surface extending between said throat and terminal ends of said wall members, with said wall members each being comprised of a base portion adjacent said terminal ends and a clip portion overlapping said base portion to define said throat as a junction between said wall members, said wall members supporting said magnetic members along said interior surface in aligned facing opposition spaced substantially apart from corresponding ones of said terminal ends, to permit magnetic attraction between said magnetic members and structurally arranged to receive insertion of a page of a book between said base portion and said clip portion until an edge of the page engages said throat; and a cover member disposed along said interior surface to form a continuous layer extending approximately from a first of said terminal ends, around said throat and to a second of said terminal ends while covering and separating said magnetic members and forming a continuously gradual structural transition along said interior surface between said terminal ends and said magnetic members that accommodates a difference in separation between said opposite wall members and between said magnetic members attributable to said thickness.

12. The magnetic clip marker in accordance with claim 11, where the junction is arranged at a medium distance between the pair of magnetic members to provide said aligned facing opposition between the pair of magnetic members.

13. The magnetic clip marker in accordance with claim 11, where disparity of the longest wall member in relation to the opposite wall member and disposition of the cover member along the interior surface facilitate the insertion of the page within the throat.

14. The magnetic clip marker in accordance with claim 11, where a portion of the integral monolithic structure extends in a linear way to one of the wall members and in an opposite direction to the throat.

15. The magnetic clip marker in accordance with claim 11, where the cover member disposed on the surface of the integral structure of the clip member is less thick than the wall members.

* * * * *